US008122570B2

(12) United States Patent
Jezzi

(10) Patent No.: US 8,122,570 B2
(45) Date of Patent: Feb. 28, 2012

(54) APPARATUS AND METHOD FOR DRY FORMING A UNIFORM NON-WOVEN FIBROUS WEB

(76) Inventor: Arrigo D. Jezzi, Bala Cynwyd, PA (US)

( * ) Notice: Subject to any disclaimer, the term of this patent is extended or adjusted under 35 U.S.C. 154(b) by 162 days.

(21) Appl. No.: 12/800,438

(22) Filed: May 14, 2010

(65) Prior Publication Data

US 2010/0289169 A1 Nov. 18, 2010

Related U.S. Application Data

(63) Continuation-in-part of application No. 12/455,201, filed on May 30, 2009, now Pat. No. 7,886,411, which is a continuation-in-part of application No. 11/825,331, filed on Jul. 6, 2007, now abandoned.

(51) Int. Cl.
*D01G 25/00* (2006.01)

(52) U.S. Cl. ..... 19/66 R; 19/304

(58) Field of Classification Search ..... 19/65 R, 19/66 R, 304

See application file for complete search history.

(56) References Cited

U.S. PATENT DOCUMENTS

| | | | |
|---|---|---|---|
| 2,447,161 | A | 8/1948 | Coghill |
| 2,748,429 | A | 6/1956 | Clark |
| 2,751,633 | A | 6/1956 | Clark |
| 2,810,940 | A | 10/1957 | Mills |
| 2,931,076 | A | 4/1960 | Clark |
| 3,575,749 | A | 4/1971 | Kroyer |
| 3,581,706 | A | 6/1971 | Rasmussen |
| 3,669,778 | A | 6/1972 | Rasmussen |
| 3,692,622 | A | 9/1972 | Dunning |
| 3,733,234 | A | 5/1973 | Dunning |
| 3,764,451 | A | 10/1973 | Dunning |
| 3,769,115 | A | 10/1973 | Rasmussen et al. |
| 3,776,807 | A | 12/1973 | Dunning et al. |
| 3,812,553 | A | 5/1974 | Marshall et al. |
| 3,825,381 | A | 7/1974 | Dunning et al. |
| 3,862,867 | A | 1/1975 | Marshall |
| 3,976,412 | A | 8/1976 | Attwood et al. |
| 3,982,302 | A | 9/1976 | Vaalburg |
| 3,984,898 | A | 10/1976 | Matsumura et al. |
| 4,004,323 | A | 1/1977 | Gotchel et al. |
| 4,014,635 | A | 3/1977 | Kroyer |
| 4,060,360 | A | 11/1977 | Tapp |
| 4,074,393 | A | 2/1978 | Hicklin et al. |
| 4,100,324 | A | 7/1978 | Anderson et al. |
| 4,160,059 | A | 7/1979 | Samejima |
| 4,260,578 | A | 4/1981 | Moody |

(Continued)

FOREIGN PATENT DOCUMENTS

| | | |
|---|---|---|
| EP | 0333209 | 9/1989 |

(Continued)

*Primary Examiner* — Shaun R Hurley

(74) *Attorney, Agent, or Firm* — Thomas J. Connelly; Wilhelm Law, S.C.

(57) ABSTRACT

An apparatus and method is disclosed for dry forming a uniform non-woven fibrous web. The apparatus includes a transport duct, a spreading member and a discharge member connected in series. The discharge member has a flexible plate and a plurality of screws which act upon the flexible plate to deflect its inner surface and provide further control of the basis weight of the to be formed fibrous web. The apparatus also has a forming zone located below the discharge member. The method combines a plurality of individual fibers with a pressurized gaseous stream and routes this stream through the apparatus to form the uniform non-woven fibrous web.

20 Claims, 4 Drawing Sheets

U.S. PATENT DOCUMENTS

| | | | | |
|---|---|---|---|---|
| 4,264,290 | A | 4/1981 | Dunkerly, II et al. | |
| 4,269,578 | A | 5/1981 | Gustavsson | |
| 4,285,647 | A | 8/1981 | Dunkerly, II | |
| 4,352,649 | A | 10/1982 | Jacobsen et al. | |
| 4,366,111 | A | 12/1982 | Dinius et al. | |
| 4,375,448 | A | 3/1983 | Appel et al. | |
| 4,494,278 | A | 1/1985 | Kroyer et al. | |
| 4,551,191 | A | 11/1985 | Kock et al. | |
| 4,640,810 | A | 2/1987 | Laursen et al. | |
| 4,688,301 | A | 8/1987 | Thorbjornsson et al. | |
| 4,701,294 | A | 10/1987 | Radwanski et al. | |
| 4,749,423 | A | 6/1988 | Vaalburg et al. | |
| 4,767,586 | A | 8/1988 | Radwanski et al. | |
| 5,471,712 | A | 12/1995 | Kroyer | |
| 5,885,516 | A | 3/1999 | Christensen | |
| 6,033,199 | A | 3/2000 | Vonderhaar et al. | |
| 7,107,652 | B2 | 9/2006 | Thordahl | |
| 7,886,411 | B2 * | 2/2011 | Jezzi | 19/66 R |
| 2006/0174452 | A1 | 8/2006 | Celli | |
| 2009/0023839 | A1 | 1/2009 | Barnholtz et al. | |
| 2009/0241831 | A1 | 10/2009 | Jezzi | |

FOREIGN PATENT DOCUMENTS

| | | |
|---|---|---|
| WO | 2009025636 | 2/2009 |

* cited by examiner

A METHOD OF DRY FORMING A UNIFORM NON-WOVEN FIBROUS WEB COMPRISING THE STEPS OF:

FORMING A PLURALITY OF INDIVIDUAL FIBERS;

ROUTING SAID PLURALITY OF INDIVIDUAL FIBERS THROUGH A TRANSPORT DUCT BY A PRESSURIZED GASEOUS STREAM, SAID TRANSPORT DUCT HAVING A PREDETERMINED CROSS-SECTIONAL AREA, SAID TRANSPORT DUCT HAVING AN ENTRANCE AND AN EXIT, AND SAID PRESSURIZED GASEOUS STREAM HAVING A VELOCITY OF AT LEAST ABOUT 1,000 FEET PER MINUTE;

DIRECTING SAID PRESSURIZED GASEOUS STREAM CONTAINING SAID PLURALITY OF INDIVIDUAL FIBERS TO A SPREADING MEMBER, SAID SPREADING MEMBER HAVING AN INLET, AN OUTLET AND HAVING A LENGTH THEREBETWEEN WHICH IS AT LEAST 20 TIMES SAID DIAMETER OF SAID TRANSPORT DUCT, SAID SPREADING MEMBER BEING A HOLLOW ENCLOSURE HAVING FIRST AND SECOND MAJOR WALLS CONNECTED TOGETHER BY A PAIR OF SIDE WALLS TO FORM A RECTANGULAR CROSS-SECTIONAL CONFIGURATION HAVING A WIDTH AND A HEIGHT, SAID WIDTH CONSTANTLY INCREASING IN DIMENSION ALONG SAID LENGTH FROM SAID INLET TO SAID OUTLET AND SAID HEIGHT CONSTANTLY DECREASING IN DIMENSION ALONG SAID LENGTH FROM SAID INLET TO SAID OUTLET, SAID HEIGHT BEING LESS THAN SAID WIDTH AT SAID OUTLET, SAID INLET OF SAID SPREADING MEMBER BEING CONNECTED TO SAID EXIT OF SAID TRANSPORT DUCT AND SAID EXIT BEING ALIGNED AT AN ANGLE OF AT LEAST ABOUT 15° TO SAID SECOND MAJOR WALL, AND SAID PRESSURIZED GASEOUS STREAM PASSING THROUGH SAID SPREADING MEMBER BEING MAINTAINED AT A CONSTANT OR SLIGHTLY ACCELERATING VELOCITY AND WITH A MINIMUM AMOUNT OF TURBULENCE;

DIRECTING SAID PRESSURIZED GASEOUS STREAM CONTAINING SAID PLURALITY OF INDIVIDUAL FIBERS TO A DISCHARGE MEMBER HAVING AN INLET OPENING, AN OUTLET OPENING AND A LENGTH THEREBETWEEN, SAID INLET OPENING BEING CONNECTED TO SAID OUTLET OF SAID SPREADING MEMBER AND HAVING AN IDENTICAL SIZE AND CROSS-SECTIONAL CONFIGURATION AS SAID OUTLET, SAID DISCHARGE MEMBER HAVING FIRST AND SECOND MAJOR WALLS CONNECTED TOGETHER BY A PAIR OF SIDE WALLS TO FORM A RECTANGULAR CROSS-SECTIONAL CONFIGURATION HAVING A WIDTH AND A HEIGHT, SAID WIDTH BEING GREATER THAN SAID HEIGHT, SAID DISCHARGE MEMBER HAVING A FIRST FLEXIBLE PLATE POSITIONED THEREIN AND ALIGNED ADJACENT TO SAID FIRST MAJOR WALL, SAID FIRST FLEXIBLE PLATE SPANNING ACROSS SAID OUTLET OPENING AND HAVING AN INNER SURFACE AND AN OUTER SURFACE, AND A PLURALITY OF SCREWS POSITIONED ACROSS SAID OUTLET OPENING, EACH OF SAID SCREWS CAPABLE OF BEING ADJUSTED SO AS TO CONTACT AND DEFLECT SAID OUTER SURFACE OF SAID FIRST FLEXIBLE PLATE AND IMPART A CORRESPONDING CONTOUR TO SAID INNER SURFACE OF SAID FIRST FLEXIBLE PLATE; AND

DEPOSITING SAID PLURALITY OF INDIVIDUAL FIBERS FROM SAID OUTLET OPENING ONTO A FORMING ZONE TO FORM A UNIFORM NON-WOVEN FIBROUS WEB.

FIG. 14

APPARATUS AND METHOD FOR DRY FORMING A UNIFORM NON-WOVEN FIBROUS WEB

CROSS REFERENCE TO RELATED APPLICATIONS

This is a Continuation-In-Part application of U.S. Ser. No. 12/455,201 filed May 30, 2009, now U.S. Pat. No. 7,886,411, which in turn is a Continuation-In-Part application of U.S. Ser. No. 11/825,331 filed on Jul. 6, 2007, now abandoned.

FIELD OF THE INVENTION

This invention relates to an apparatus and method for dry forming a uniform non-woven fibrous web. More particularly, this invention relates to an apparatus and method of dry forming a uniform non-woven fibrous web which has a basis weight of less than about 100 grams per square meter.

BACKGROUND OF THE INVENTION

Today, various types of textile fibers including: staple fibers, cellulose fibers, defibrated cellulose fibers, and blends of two or more different fibers can be dry formed into non-woven fabrics by a variety of well known methods. Currently, there exist many different kinds of apparatuses for the uniform distribution of air-laid fibers, especially staple textile fibers and cellulose pulp fibers. However, many of these apparatuses are highly complex mechanical devices, some of which are rather cumbersome, that suffer from one or more disadvantages.

Many of the non-woven fabrics formed on such machines, especially those formed from cellulosic fibers, exhibited good entanglement and matt structure but have little strength. Most staple fibers provide little strength characteristics. For this reason, such fabrics have usually been utilized in absorbent articles, such as absorbent diapers, absorbent feminine pads, absorbent incontinent articles, etc. where strength is not a requirement. In addition, some of these non-woven fabrics have been used in applications where a certain minimum strength is required but the tactile and absorbency properties are unimportant, for example in various specialty papers.

With the development of new and various products, manufacturers would like to run their processes at higher speeds. In addition, some manufacturers would like to use short cellulosic fibers along with the longer staple fibers to improve strength characteristics. The short cellulosic fibers are typically only about 2 to about 3 millimeters in length. Furthermore, many manufacturers would like to be able to form a web that exhibits uniformity in both the machine direction and in the cross direction. Another request from a number of manufacturers is for an apparatus that is capable of making light weight fabrics at current production line speeds, especially those having a basis weight of less than 100 grams per square meter (gsm). Even more so, a number of manufacturers would like to see an apparatus offered for sale that is capable of making light weight fabrics, especially those fabrics having a basis weight of around 75 gsm, 50 gsm, 30 gsm or even a basis weight of about 20 gsm.

Now, an apparatus and method for dry forming a uniform non-woven fibrous web has been invented which can accommodate current production line speeds.

SUMMARY OF THE INVENTION

Briefly, this invention relates to an apparatus and method of dry forming a uniform non-woven fibrous web. The apparatus includes a transport duct having a predetermined cross-sectional area. The transport duct has an entrance and an exit. The entrance is connected to a source of individual fibers and a pressurized gaseous stream. The transport duct is capable of routing a plurality of the individual fibers contained within the pressurized gaseous stream through to the exit. The apparatus also includes a spreading member having an inlet, an outlet and having a length therebetween. The spreading member is a hollow enclosure having first and second major walls connected together by a pair of side walls to form a rectangular cross-sectional configuration having a width and a height. The width constantly increases in dimension along the length from the inlet to the outlet and the height constantly decreases in dimension along the length from the inlet to the outlet. The height is less than the width at the outlet. The inlet of the spreading member is connected to the exit of the transport duct and the exit is aligned at an angle of at least about 15° to the second major wall. The pressurized gaseous stream passing through the spreading member is maintained at a constant or slightly accelerating velocity and with a minimum amount of turbulence. The apparatus further includes a discharge member having an inlet opening, an outlet opening and a length therebetween. The inlet opening is connected to the outlet of the spreading member and has an identical size and cross-sectional configuration as the outlet. The discharge member has first and second major walls connected together by a pair of side walls to form a rectangular cross-sectional configuration having a width and a height. The width is greater than the height. The apparatus further includes a first flexible plate positioned within the discharge member and aligned adjacent to the first major wall. The first flexible plate spans across the outlet opening and has an inner surface and an outer surface. A plurality of screws is positioned across the outlet opening. Each of the screws is capable of being adjusted so as to contact and deflect the outer surface of the first flexible plate and impart a corresponding contour to the inner surface of the first flexible plate. Lastly, a forming zone is located below the outlet opening of the discharge member onto which a uniform dispersion of the fibers can be deposited to form a uniform non-woven fibrous web.

The method of dry forming a uniform non-woven fibrous web includes the steps of forming a plurality of individual fibers and then routing the plurality of individual fibers through a transport duct by a pressurized gaseous stream. The transport duct has a predetermined cross-sectional area. The transport duct also has an entrance and an exit. The pressurized gaseous stream has a velocity of at least about 1,000 feet per minute. The method also includes directing the pressurized gaseous stream containing the plurality of individual fibers to a spreading member. The spreading member has an inlet, an outlet and having a length therebetween which is at least 20 times the diameter of the transport duct. The spreading member is a hollow enclosure having first and second major walls connected together by a pair of side walls to form a rectangular cross-sectional configuration having a width and a height. The width constantly increases in dimension along the length from the inlet to the outlet and the height constantly decreases in dimension along the length from the inlet to the outlet. The height is less than the width at the outlet. The inlet of the spreading member is connected to the exit of the transport duct and the exit is aligned at an angle of at least about 15° to the second major wall. The pressurized gaseous stream passing through the spreading member is maintained at a constant or slightly accelerating velocity and with a minimum amount of turbulence. The method further includes directing the pressurized gaseous stream containing the plurality of individual fibers to a discharge member having an inlet opening, an outlet opening and a length therebetween. The inlet opening is connected to the outlet of the spreading member and has an identical size and cross-sectional configuration as the outlet. The discharge member has first and second major walls connected together by a pair of side walls to form a rectangular cross-sectional configuration having a width and a height. The width is greater than the height. The discharge member has a first flexible plate positioned therein and aligned adjacent to the first major wall. The first flexible plate spans across the outlet opening and has an inner surface and an outer surface. A plurality of screws is positioned across the outlet opening. Each of the screws is capable of being adjusted so as to contact and deflect the outer surface of the first flexible plate and impart a corresponding contour to the inner surface of the first flexible plate. Lastly, the method includes depositing the plurality of individual fibers from the outlet opening onto a forming zone to form a uniform non-woven fibrous web.

The general object of this invention is to provide an apparatus and method for dry forming a uniform non-woven fibrous web. A more specific object of this invention is to provide an apparatus and method of dry forming a uniform non-woven fibrous web which has a basis weight of less than about 100 grams per square meter.

Another object of this invention is to provide an apparatus and method of dry forming a uniform non-woven fibrous web which has a basis weight of from between about 20 gsm to about 75 gsm.

A further object of this invention is to provide an apparatus for dry forming a uniform non-woven fibrous web which is void of any baffles which can pivot.

Still another object of this invention is to provide an apparatus for dry forming a uniform non-woven fibrous web which is easy to construct and maintain.

Still further, an object of this invention is to provide is to provide a continuous method of dry forming a uniform non-woven fibrous web.

Other objects and advantages of the present invention will become more apparent to those skilled in the art in view of the following description and the accompanying drawings.

BRIEF DESCRIPTION OF THE DRAWINGS

FIG. 14 is a flow diagram of a method of dry forming a uniform non-woven fibrous web.

DETAILED DESCRIPTION OF THE INVENTION

Figure 1:
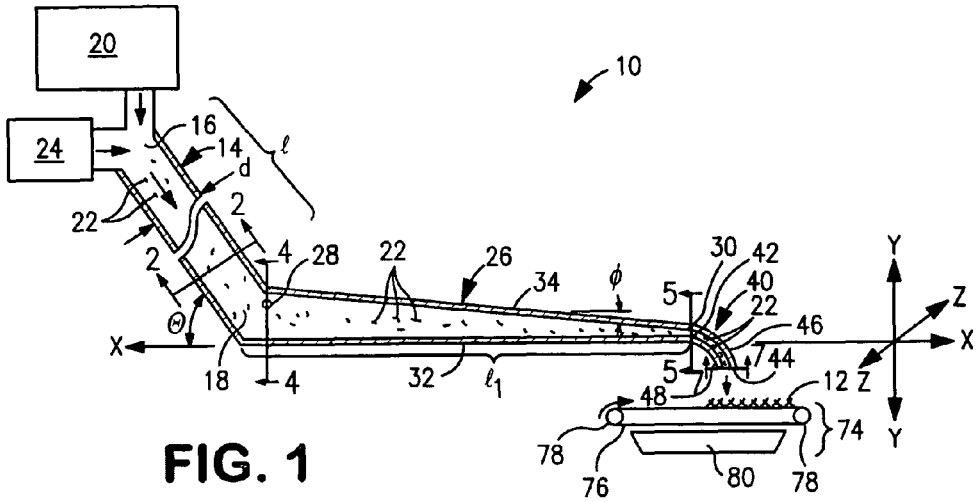
FIG. 1 is a side elevation view of an apparatus for dry forming a uniform non-woven fibrous web showing a transport duct, a spreading member and a discharge member in cross-section such that the velocity of a pressurized gaseous stream containing a plurality of individual fibers is maintained constant or slightly accelerated through the spreading member while maintaining laminar flow with a minimum amount of turbulence.

Referring to FIG. 1, an apparatus 10 is shown for dry forming a uniform non-woven fibrous web 12. The apparatus 10 will be described relative to a longitudinal central axis X-X, a vertical central axis Y-Y and a transverse central axis Z-Z. The apparatus 10 includes a transport duct 14 having a predetermined cross-sectional area. The transport duct 14 has a diameter d which can be constant. The transport duct 14 is shown being oriented relative to the vertical central axis Y-Y. However, one can change the orientation of the various components of the apparatus 10 if it suits his needs. The diameter d of the transport duct 14 can vary depending upon the desired flow volume one needs through the transport duct 14. The diameter d of the transport duct 14 can range from about 1 inch up to about 18 inches or higher. For a pilot line operation, the diameter d of the transport duct 14 can range from between about 1 inch to about 4 inches. For a commercial operation, the diameter d of the transport duct 14 should be at least 6 inches and desirably should be in the range of from between 6 inches to about 18 inches. More desirably, the diameter d of the transport duct 14 is from between about 12 inches to about 16 inches to a commercial operation.

Figure 2:
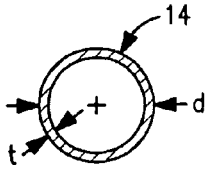
FIG. 2 is a cross-sectional view of the transport duct taken along line 2-2 of FIG. 1.

As shown in FIG. 2, the transport duct 14 has a wall thickness t which can vary in dimension. Desirably, the wall thickness t is at least 0.2 inches. More desirably, the wall thickness t is at least 0.25 inches. Even more desirably, the wall thickness t is at least 0.3 inches.

Referring again to FIG. 1, the flow through the transport duct 14 can vary depending on the actual construction of the transport duct 14, the type of fibers utilized and the dimensions, such as the length, width, thickness and the basis weight of the web 12 that one wishes to form. For best results, the transport duct 14 should be linear or straight and have a length that is at least 20 times its diameter d. Typically, the flow through the transport duct 14 is at least about 1,000 feet per minute (fpm) or higher. For a commercial operation, the flow through the transport duct 14 can range from between about 1,000 fpm to about 6,000 fpm. Desirably, the flow through a transport duct 14, having a diameter d of from between about 12 inches to about 16 inches, is from between about 1,000 fpm to about 5,000 fpm. More desirably, the flow through the transport duct 14, having a diameter d of from between about 12 inches to about 16 inches, is from between about 2,000 fpm to about 6,000 fpm. Even more desirably, the flow through a transport duct 14, having a diameter d of from between about 12 inches to about 16 inches, is at least 3,000 fpm.

The transport duct 14 has an entrance 16 and an exit 18. The entrance 16 is connected to a source 20 of individual fibers 22 and to a pressurized gaseous stream 24. The source 20 of the individual fibers 22 can be a hammermill or other piece of equipment that is capable of separating a sheet or batt of fibers into a plurality of individual fibers 22. Kamas, M&J, and Famecannica are three companies that make commercial equipment to defibrate pulp into individual fibers 22. The individual fibers 22 can vary in shape, size and material from which they are formed. The individual fibers 22 can be textile fibers made up of natural or synthetic fibers. The individual fibers 22 can be staple fibers having a length of from between about 1 inch to about 2 inches, short fibers having a length of from between about 2 to about 3 millimeters, or be a blend of both long staple fibers and short fibers. Desirably, the individual fibers 22 can be cellulosic fibers derived from wood pulp, sometimes referred to as cellulosic fluff fibers. Alternatively, the individual fibers 22 can be derived from various parts of plants or trees, such as from the leaves of eucalyptus trees and palm trees, to obtain cellulosic fibers.

The pressurized gaseous stream 24 is used to convey or route the plurality of individual fibers 22 into and through the apparatus 10. Desirably, the gaseous medium is air since it is inexpensive and easy to handle. However, any known gas could be used to convey the plurality of individual fibers 22 through the apparatus 10.

As stated above, it is beneficial to construct the transport duct 14 such that it is linear or has a minimum number of curves or bends. One reason for constructing the transport duct 14 as a hollow linear tube or pipe is to limit pressure drops therein. A straight tube or pipe having a length l that is at least 20 to 1 relative to the diameter d will allow the plurality of individual fibers 22 being carried by the pressurized gaseous stream to acquire the same velocity as the gaseous stream. By "velocity" it is meant rapidity or speed of motion; swiftness.

For the purpose of discussion of the invention the term "web" as used herein will include batt and/or substrate. In the case of forming an absorbent web in which the thickness or basis weight of the web 12 is large, in the range of 100 or more grams per square meter (gsm), the aerodynamic characteristics of the fluff forming device, i.e. hammermill, is not critical. However, the aerodynamic and design characteristics of the forming device become more critical when the requirement is to form a web 12 having a basis weight of less than about 100 gsm; or to form a web 12 having a basis weight of less than about 75 gsm; or to form a web 12 having a basis weight of less than about 50 gsm; or to form a web 12 having a basis weight of less than about 30 gsm; or to form a web 12 having a basis weight of about 20 gsm. The challenge becomes taking the plurality of individual fibers 22 that are being conveyed in a round or circular transport duct 14, at velocities in the range of about 1,000 fpm to about 10,000 fpm or higher, and spreading the individual fibers 22 to a width of about 1.5 meters or greater while achieving a uniformity of the individual fibers 22. In some cases, the formed web 12 will have a uniform width of from between about 1.5 meters to about 5.4 meters or greater. In the web forming industry, a uniformity ranging from ±10%, measured by accepted standard test methods, is considered normal.

The transport duct 14 is capable of routing the plurality of the individual fibers 22 contained within the pressurized gaseous stream 24 through to the exit 18. It should be understood that the concentration of the plurality of individual fibers 22 in the pressurized gaseous stream 24 within the transport duct 14 can vary. Desirably, the concentration of the individual fibers 22 in the pressurized gaseous stream within the transport duct 14 is at least about 250 cubic feet per pound of fibers 22. More desirably, the concentration of the individual fibers 22 in the pressurized gaseous stream within the transport duct 14 is at least about 350 cubic feet per pound of fibers 22. Even more desirably, the concentration of the individual fibers 22 in the pressurized gaseous stream within the transport duct 14 is at least about 400 cubic feet per pound of fibers 22. Most desirably, the concentration of the individual fibers 22 in the pressurized gaseous stream within the transport duct 14 is greater than about 500 cubic feet per pound of fibers 22.

Still referring to FIGS. 1 and 3-5, the apparatus 10 also includes a spreading member 26 having an inlet 28, an outlet 30 and having a length $l_1$ therebetween. The length $l_1$ is at least 10 times the diameter d of the transport duct 14. Desirably, the length $l_1$ is at least 15 times the diameter d of the transport duct 14. More desirably, the length $l_1$ is at least 20 times the diameter d of the transport duct 14. In numerical values, the length $l_1$ of the spreading member 26 should be at least 20 feet long when the diameter d of the transport duct 14 is 12 inches. The spreading member 26 is a hollow enclosure having first and second major walls, 32 and 34 respectively, connected together by a pair of side walls 36 and 38. Each of the first and second major walls, 32 and 34 respectively, has a trapezoidal configuration, see FIG. 3, which increases in width w from the inlet 28 to the outlet 30. By trapezoid it is meant a quadrilateral having two parallel sides.

In addition, the first major wall 32 is shown angling downward from the inlet 28 to the outlet 30 while the second major wall 34 is aligned parallel to the longitudinal central axis X-X, from the inlet 28 to the outlet 30. In other words, the first major wall 32 tapers vertically downward from a horizontal plane by an angle phi Ø. The angle phi Ø can vary in degrees. Desirably, the angle phi Ø ranges from between about 1° and about 35°. More desirably, the angle phi Ø ranges from between about 5° and about 30°. Even more desirably, the angle phi Ø ranges from between about 10° and about 25°. Unlike the first major wall 32, the second major wall 34 is aligned in a horizontal plane. Alternatively, one can construct the spreading member 26 such that each of the first and second major walls, 32 and 34 respectively, converge toward one another as they approach the outlet 30.

It should be understood that the fiber velocity is equivalent to the velocity of the pressurized gaseous stream 24 in the transport duct 14 and the iso-kinetic energy of the individual fibers 22 is dissipated and greatly reduced as the fibers 22 enter the spreading member 26. This is accomplished by the structure of the transport duct 14 and the angle that it is oriented to the spreading member 26. This geometry caused the individual fibers 22 leaving the transport duct 14 to strike or hit the inside surface of the first major wall 32 of the spreading member 26. In this manner, both the velocity and the momentum of the individual fibers 22 are dissipated. This action allows the individual fibers 22 to then be realigned with the airflow profiles in the spreading member 26 that will be developed by the geometries and air velocities used in the design of the spreading member 26.

If the iso-kinetic energy of the individual fibers 22 was not dissipated in the fashion explained above, then the individual fibers 22 could have a tendency to stay in the center of the spreading member 26 and thereby create a heavier basis weight in the center of the to be formed non-woven fabric web 12. The angle at which the transport duct 14 is aligned with the spreading member 26 can vary as long as the velocity of the individual fibers 22 is dissipated as they strike the inside surface of the first major wall 32. The angle at which the transport duct 14 enters the spreading member 26 will depend upon the height to width ratio of the spreading member 26. This angle can vary from between about 15° to about 90°. Typically, it will be closer to about 45° for most applications. Other means of controlling the iso-kinetic energy of the individual fibers 22 at the inlet 28 to the spreading member 26 can be used. Within the spreading member 26 it is important that the plurality of individual fibers 22 have enough residence time to streamline themselves to the airflow that has been developed in the spreading member 26. This is accomplished by constructing the length $l_1$ of the spreading member 26 such that it is at a minimum equivalent to 10 times the diameter d of the transport duct 14. Desirably the length $l_1$ of the spreading member 26 is at least 20 times the diameter d of the transport duct 14. Lengths $l_1$ much shorter than 10 times the equivalent diameter d of the transport duck 14 will result in less efficient fiber spreading in the cross direction and unacceptable profiles.

As there may be physical limitations to optimizing the spreading member 26 to lengths $l_1$ greater than 10 equivalent diameters d of the transport duct 14, the angle of the exit 18 to the inlet 28 of the spreading member 26 will need to be adjusted accordingly to accommodate this relationship.

Figure 4:
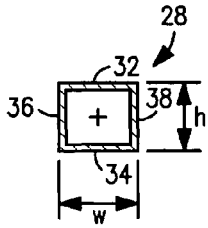
FIG. 4 is a cross-sectional view of the spreading member taken along line 4-4 of FIG. 1.
Figure 5:
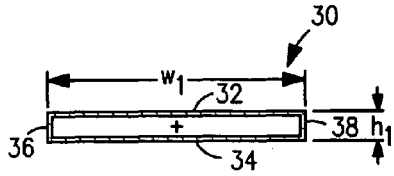
FIG. 5 is a cross-sectional view of the outlet of the spreading member taken along line 5-5 of FIG. 1.

Referring to FIGS. 4 and 5, the four walls 32, 34, 36 and 38 form a rectangular cross-sectional configuration having a width w and a height h. The width w is measured parallel to the Z-Z axis and the height h is measured parallel to the Y-Y axis. At the inlet 28, the height h of the pair of side walls 36 and 38 can have a dimension that approaches the width w of the first and second major walls, 32 and 34 respectively. If desired, the four walls 32, 34, 36 and 38 can form a square configuration adjacent the inlet 28. The width w at the inlet 28 can be about 10 inches or more and the height h can be about 10 inches or more. Desirably, the width w at the inlet 28 can be about 12 inches or more and the height h can be about 12 inches or more. More desirably, the width w at the inlet 28 can be about 16 inches or more and the height h can be about 16 inches or more.

The width w constantly increases in dimension along the length $l_1$ from the inlet 28 to the outlet 30 and the height h constantly decreases in dimension along the length $l_1$ from the inlet 28 to the outlet 30. The height h is less than the width w at the outlet 30, see FIG. 5. This means that at the outlet 30, the four walls 32, 34, 36 and 38 form a rectangular cross-sectional configuration with a width $w_1$ and a height $h_1$. The width $w_1$ at the outlet 30 is much greater than the width w at the inlet 28, and the height $h_1$ at the outlet 30 is much less than the height h at the inlet 28. In addition, at the outlet 30, the width $w_1$ dimension is much greater than the height $h_1$ dimension. Desirably, the width $w_1$ is greater than about 1 meter. More desirably, the width $w_1$ ranges from between about 1 meter to about 5.5 meters. Even more desirably, the width $w_1$ ranges from between about 1 meter to about 3 meters. Most desirably, the width $w_1$ ranges from between about 1 meter to about 2 meters. Furthermore, at the outlet 30, the height $h_1$ is less than about 6 inches. Desirably, at the outlet 30, the height $h_1$ is less than about 4 inches. More desirably, at the outlet 30, the height $h_1$ is less than about 3 inches. Even more desirably, at the outlet 30, the height $h_1$ is less than about 2 inches. Most desirably, at the outlet 30, the height $h_1$ is from between about 1 inch to about 2 inches.

Referring again to FIG. 1, the inlet 28 of the spreading member 26 is connected to the exit 18 of the transport duct 14. The exit 18 is aligned at an angle theta θ to the second major wall 34. The angle theta θ can vary in degrees. Desirably, the angle theta θ is at least about 15° to the second major wall 34. More desirably, the angle theta θ is from between about 15° to about 75° to the second major wall 34. More desirably, the angle theta θ is from between about 40° to about 50° to the second major wall 34. Even more desirably, the angle theta θ is around 45° to the second major wall 34.

The function of the spreading member 26 is to transform the pressurized gaseous stream 24 containing the plurality of individual fibers 22 into an extremely uniform flow in cross-section as it approaches the outlet 30. This is accomplished by maintaining constant or slightly accelerating velocities through the spreading member 26 with a minimum amount of turbulence. As the pressurized gaseous stream 24 passes through the spreading member 26 it is maintained at a constant or slightly accelerating velocity due to the geometrical configuration of the spreading member 26. In order to accomplish this, the cross-sectional area of the transport duct 14 should be the same or slightly greater than the cross-sectional area of the outlet 30 of the spreading member 26. This concept of maintaining constant or slightly accelerating gaseous (air) velocities through any cross sectional plane present in the spreading member 26 is important in achieving uniform cross direction gaseous (air) profiles at the outlet 30 of the spreading member 26.

Figure 3:
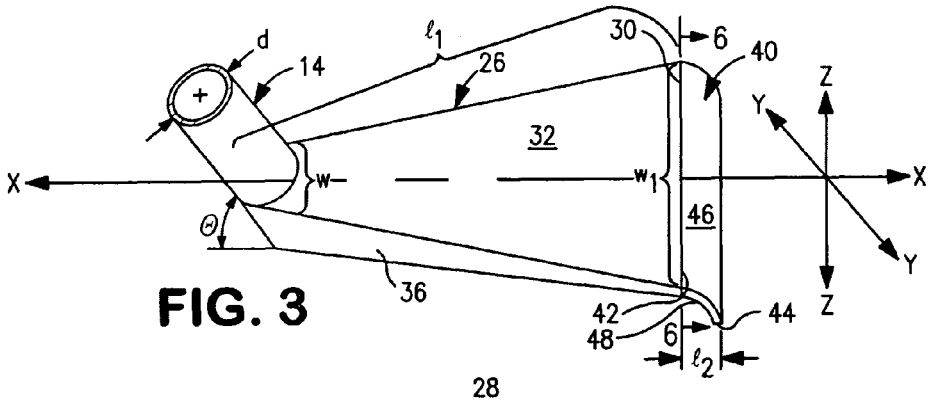
FIG. 3 is a perspective view of the apparatus shown in FIG. 1, except for the source of the pressurized gaseous stream and the source of the plurality of individual fibers, and depicts the trapezoidal shape of the spreading member.

Referring again to FIGS. 1, 3, 6 and 7, the apparatus 10 further includes a discharge member 40 having an inlet opening 42, an outlet opening 44 and a length $l_2$ therebetween. The size and configuration of the discharge member 40 can vary. The discharge member 40 can be straight or linear in appearance, be curvilinear, have an arcuate configuration or have some other geometrically configuration. As depicted in FIGS. 1 and 3, the discharge member 40 has an arcuate configuration between the inlet opening 42 and the outlet opening 44 which spans an arc of from between about 1° to about 90°. By "arc" it is meant a segment of a circle.

Figure 6:
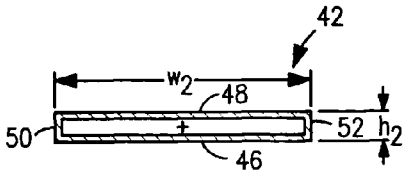
FIG. 6 is a cross-sectional view of the inlet opening to the discharge member taken along line 6-6 of FIG. 3.

Referring to FIGS. 1 and 6, the inlet opening 42 of the discharge member 40 is connected to the outlet 30 of the spreading member 26. Both the inlet opening 42 and the outlet 30 have an identical size and cross-sectional configuration. The discharge member 42 has first and second major walls, 46 and 48 respectively, connected together by a pair of side walls 50 and 52 to form a rectangular cross-sectional configuration having a width $w_2$ and a height $h_2$. The width $w_2$ is measured parallel to the Z-Z axis and the height $h_2$ is measured parallel to the Y-Y axis. The width $w_2$ is greater than the height $h_2$. In FIG. 6, the first major wall 46 is depicted as being the lower or bottom wall while the second major wall 48 is shown as being the upper or top wall.

In FIGS. 1 and 6, one will notice that the inlet opening 42 is void of any baffles. In other words, there is no movable baffle that is mounted on a pivot or hinge which can be moved, swung or be partially rotated so as to alter or change the cross-sectional size of the opening between the outlet 30 of the spreading member 26 and the inlet opening 42 of the discharge member 40. In fact, the outlet 30 of the spreading member 26 is identical in size and cross-sectional shape to the inlet opening 42 of the discharge member 40. There are no movable components at this location which could obstruct the pressurized gaseous stream 24. This is an important difference over U.S. Pat. No. 3,812,553 issued to Marshall et al. on May 28, 1974 and entitled: "REORIENTATION OF FIBERS IN A FLUID STREAM".

Figure 7:
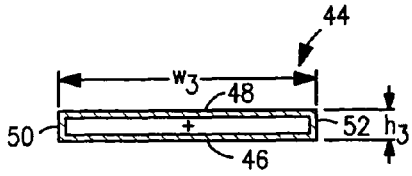
FIG. 7 is a cross-sectional view of the outlet opening of the discharge member taken along line 7-7 of FIG. 1.

Referring now to FIG. 7, the cross-section of the outlet opening 44 of the discharge member 40 is shown. One will notice that it is a rectangular configuration of identical size and configuration to the inlet opening 42. In fact, the cross-sectional area of the discharge member 40 remains constant throughout its length $l_2$. Alternatively, the cross-sectional area of the discharge member 40 could decrease slightly throughout its length $l_2$ so as to allow the velocity of the pressurized gaseous stream 24 to slightly increase, if desired. This is an important distinction over U.S. Pat. No. 3,862,867 issued to Marshall on Jan. 28, 1975 and entitled: "PROCESS FOR PRODUCING REINFORCED NONWOVEN FABRICS". The rectangular cross-sectional configuration of the outlet opening 44 has a width $w_3$ and a height $h_3$. The width $w_3$ is measured parallel to the Z-Z axis and the height $h_3$ is measured parallel to the Y-Y axis. The width $w_3$ is greater than the height $h_3$. For example, the width $w_3$ can range from between about 30 inches to about 90 inches, desirably, about 45 inches to about 70 inches, and more desirably, from between about 50 inches to about 65 inches. The height $h_3$ can range from between about 0.5 inches to about 4 inches, desirably about 1 inch to about 3 inches, and more desirably, from less than about 2 inches.

Figure 8:
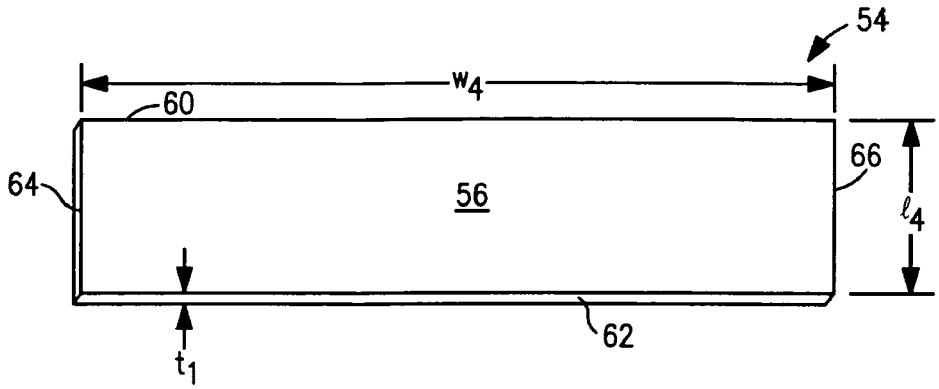
FIG. 8 is a perspective view of a flexible plate.
Figure 9:
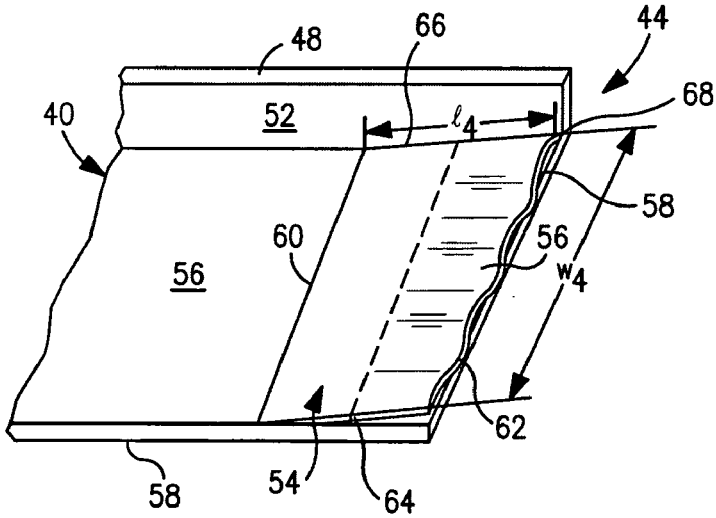
FIG. 9 is an enlarged perspective view of an undulating flexible plate secured to the inner surface of first major member and spanning across the outlet opening.
Figure 10:
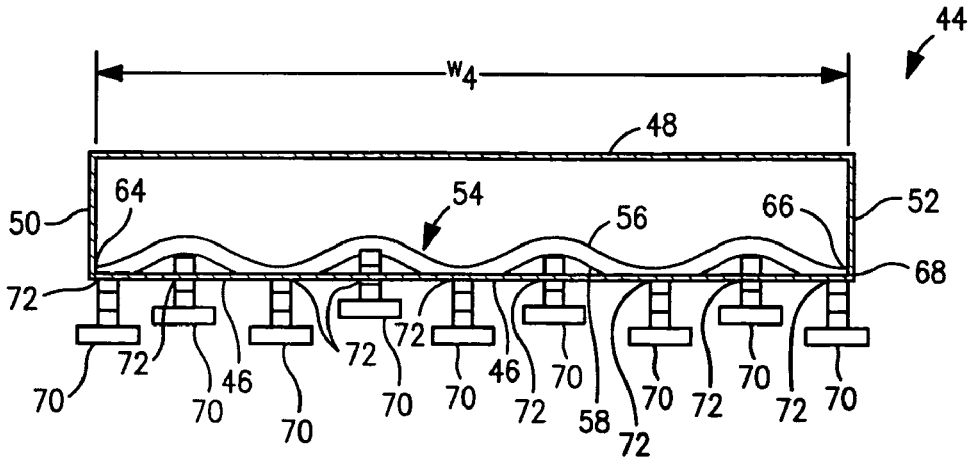
FIG. 10 is a cross-sectional view of the outlet opening of the discharge member showing a first flexible plate deflected by a plurality of screws arranged across the outlet opening such that the first flexible plate acquires an undulating contour to further control the basis weight of the to be formed uniform non-woven fibrous web.

Referring now to FIGS. 8-10, the apparatus 10 further includes a first flexible plate 54 which is positioned within the discharge member 40. The first flexible plate 54 is aligned adjacent to the first major wall 46 and spans across the width $w_3$ of the outlet opening 44 of the discharge member 40. The first flexible plate 54 has an inner surface 56 and an outer surface 58. The first flexible plate 54 can be constructed from various materials. The first flexible plate 54 can be constructed of a soft but strong flexible metal, plastic or composite material. For example, the first flexible plate 54 can be made from a metal, such as iron, cast iron, steel, stainless steel; a metal alloy such as titanium; a nonferrous metal such as aluminum; a plastic; fiberglass, a thermoplastic such as a polyolefin, polyethylene or polypropylene; a thermoplastic resin such as polytetrafluoroethylene; or from a composite material formed from two or more different materials. The first flexible plate 54 can vary in thickness depending upon the material from which it is constructed. The first flexible plate 54 should be formed such that it can bend as a force is applied to its outer surface 58. Desirably, the first flexible member 54 is malleable and can be bent multiple times without cracking or breaking.

Referring again to FIG. 8, the first flexible plate 54 is depicted as a relatively flat, rectangular member. The first flexible plate 54 can vary in size and configuration. The first flexible plate 54 has a width $w_4$ which is aligned parallel to the width $w_3$ of the outlet opening 44. The first flexible plate 54 also has a length $l_4$ which is aligned perpendicular to the width $w_4$. Lastly, the first flexible plate 54 has a thickness $t_1$. The width $w_4$ is slightly less than the width $w_3$ of the discharge member 40 so that it can fit inside the outlet opening 44, see FIG. 7. In numerical values, the width $w_4$ can range from between about 30 inches to about 90 inches, desirably, about 45 inches to about 70 inches, and more desirably, from between about 50 inches to about 65 inches. The length $l_4$ can vary but should be at least about 2 inches. Desirably, the length $l_4$ can range from between about 2 inches to about 12 inches or more. More desirably, the length $l_4$ can range from between about 2 inches to about 6 inches. Even more desirably, the length $l_4$ can range from between about 2 inches to about 4 inches. The thickness $t_1$ can vary depending upon the material from which the first flexible plate 54 is made. For most application, the first flexible plate 54 should be less than about 0.25 inches thick, desirably, less than about 0.2 inches thick, and more desirably, less than about 0.15 inches thick.

The first flexible plate 54 has a leading edge 60 secure to the first major wall 46 and an unsecured edge 62 located downstream from the leading edge 60. The attachment of the leading edge 60 to the inner surface 56 of the discharge member 40 can be by various means known to those skilled in the art, including but not limited to welding, chemical bonds, adhesives, mechanical fasteners, etc. The junction of the leading edge 60 with the inner surface 56 should be smooth and feathered so that no lip, shoulder or abutment is present. The first flexible plate 54 also has a pair of side edges 64 and 66 aligned perpendicular to the leading edge 60. These side edges 64 and 66 can be left unattached to the pair of side walls 50 and 52. Alternatively, one or both of these side edges 64 and 66 can be secured to the adjacent side wall 50 and 52. In FIG. 9, the side edge 66 is depicted as being secured to the inner surface of the side wall 52 by an attachment 68. The unsecured edge 62 is aligned approximately with the outlet opening 44. In FIG. 9, the unsecured edge 62 is aligned with the terminal end of the inner surface 56 of the discharge member 40.

Referring to FIG. 10, a plurality of screws 70 are shown positioned across the width $w_3$ of the discharge member 40. Alternatively, the plurality of screws 70 can be positioned across the width of the outlet opening 44. Each of the screws 70 is threaded into an aperture 72 formed through the first major wall 46. Each of the screws 70 is capable of being adjusted so as to contact and deflect the outer surface 58 of the first flexible plate 54 and impart a corresponding contour to the inner surface 56 of the first flexible plate 54. In FIG. 10, the first flexible plate 54 is shown having been deformed into an undulating form. However, almost any linear, non-linear or combination linear and non-linear shape can be imparted into the first flexible plate 54 including but not limited to: a shape with flat or straight sections, an arcuate shape, a U-shape, an inverted U shape, a sinusoidal shape, a convex shape, a concave shape, a W shape, etc.

The number of screws 70 can vary as well as their location and there arrangement relative to the unsecured edge 62. The screws 70 should be positioned inward about 0.1 inches to about 3 inches from the edge of the outlet opening 44. The closer the screws 70 are located relative to the unsecured edge 62 of the first flexible plate 54 the better it is because they can impart a greater distortion to the first flexible plate 54. The screws 70 can be evenly spaced apart or be unevenly spaced apart. There should be at least 1 screw 70 per foot spaced across the width $w_3$ of said discharge member 40. Desirably, there are at least 2 screws 70 per foot spaced across the width $w_3$ of said discharge member 40. More desirably, there are from 1 to 3 screws 70 per foot spaced across the width $w_3$ of said discharge member 40. Desirably, there are from 1 to 4 screws 70 per foot spaced across the width $w_3$ of said discharge member 40. Even more desirably, there are from 1 to 5 screws 70 per foot spaced across the width $w_3$ of said discharge member 40. Another guideline is to have from between 2 to 9 screws 70 evenly spaced across the width $w_3$ of the discharge member 40 when the discharge member 40 has a width $w_3$ of greater than about 12 inches and less than about 65 inches.

Each of the screws 70 has a distance of travel which can range from between about 0.1 inches to about 3 inches. Desirably, the range of travel of each screw 70 is from between about 0.25 inches to about 2.5 inches. More desirably, the range of travel of each screw 70 is from between about 0.5 inches to about 2 inches. The amount of travel capable by one screw 70 does not have to equal the amount of travel capable by another screw 70. However, to reduce cost, all of the screws 70 should be of the same length and each should be capable of approximately the same amount of travel. In order to fine tune the pressurized gaseous stream 24 exiting the outlet opening 44 of the discharge member 40, one can adjust certain screws 70 so that they impinge on the outer surface 58 of the first flexible plate 54 and force it to acquire a unique contour. By tightening or threading a screw 70 into the first major wall 46, one can cause the terminal end of the screw 70 to contact the outer surface 58 of the first flexible plate 54 and cause it to deflect upward. All of the screws 70 do not need to be tightened. As shown in FIG. 10, every other screw 70 may be tightened to establish an undulating contour. Measurements can be taken with state of the art flow meters to identify what portions of the first flexible plate 54 needs to be raised or lowered in order to obtain the optimal flow.

By deflecting the first flexible plate 54 upward into the outlet opening 44, one can constrict the cross-sectional area of the outlet opening 44. By "constrict" it is meant to make smaller or narrower. By constricting the size of the outlet opening 44, one can influence the trajectory of both the individual fibers 22 and the pressurized gaseous (air) stream 24. This ability to finely regulate the pressurized gaseous stream 24 containing the plurality of individual fibers 22 permits one to dry form a more uniform non-woven fibrous web 12. One can create restrictions in the outlet opening 44 of the discharge member 40 in the vicinity of 0.25 inches to about 0.75 inches. These restrictions serve to accelerate the discharge fibers 22 and the pressurized gaseous stream 24 and allow the fibers 22 in these particular areas to spread out causing an adjustment in the basis weight. Adjustments made using the apparatus 10 can result in a correction of ±3 grams per square meter in the fibrous web 12 being formed. By controlling the points of restriction in the flow pattern at the outlet opening 44, one can fine tune any irregularities to the basis weight profile of the finished dry formed uniform non-woven fibrous web 12.

Even though the discharge member 40 does not have to be constructed in the shape of an arc, by constructing the discharge member 40 to span an arc of approximately 90°, the effect of the first flexible plate 54 can be optimized by the curvature of the full width $w_3$ of the monolithic discharge member 40. The curvature of the discharge member 54 tends to cause the individual fibers 22 in the pressurized gaseous stream 24 to hug the first major wall 46 (the bottom wall) of the discharge member 40. As a result of iso-kinetic and centrifugal forces, the individual fibers 22 become more susceptible to movement and redistribution in the pressurized gaseous stream 24 as a result of the adjustments made to the first flexible plate 54.

The angle at which the individual fibers 22 exit the outlet opening 44 can vary depending on the nature of the forming zone 74 onto which the individual fibers 22 are discharged, as well as the effectiveness of the control exhibited by varying the gap of the outlet opening 44 by the first flexible plate 54. Consequently, the control originally exhibited on the individual fibers 22 exiting the outlet opening 44 are reduced when the discharge member 40 spans an arc of 90°. As the angle is increased from 90° to 180°, the individual fibers 22 would tend to become more evenly distributed through the entire cross-section of the discharge member 40. Consequently, a further improvement can be obtained by constricting both the second major wall 48 and the first major wall 46 (the top and bottom walls) of the outlet opening 44. This will be explained more fully below with reference to FIG. 11.

Referring again to FIG. 1, a forming zone 74 is positioned or located below the outlet opening 44 of the discharge member 40. The forming zone 74 can vary in design, function and equipment. The forming zone 74 is depicted as having a continuous screen 76 onto which the plurality of individual fibers 22 can be deposited to form a uniform non-woven fibrous web 12. The screen 76 is advanced in a continuous fashion around two or more rollers 78, at least one of which is a drive roller. A vacuum box 80 is located beneath the screen 76 and operates by pulling a vacuum such that the plurality of individual fibers 22 are deposited on the upper surface of the screen 76 and the discharged gaseous stream (air) is drawn away by the vacuum box 80.

It should be noted that those skilled in the art are familiar with various forming zones and almost any of them can be employed with the above described apparatus 10.

An important element of this invention is the ability to control the discharge of the plurality of individual fibers 22 into a forming zone 74. The forming zone can be a foraminous forming screen or other equipment known to those skilled in the art. Alternatively, the plurality of individual fibers 22 can be discharged into another fiber stream or onto a fiber matrix in order for the plurality of individual fibers 22 to blend with different fibers to form a non-woven fibrous web 12. For example, a plurality of individual cellulosic fibers can be discharged onto a meltblown fiber matrix to form an improved web. The ability to control the discharge of the plurality of individual fibers 22 allows for the formation of a uniform basis weight web.

In this case, the angle at which the individual fibers 22 are directed into either type of forming zone 74 is important. This angle may require adjustment. In FIGS. 1 and 3, the discharge member 40 turns the plurality of individual fibers 22 through an arc of 90°. This angle can be varied and can be whatever the final forming zone 74 requires. Alternatively, one could tilt the spreading member 26 and the discharge member 40 to an angle which is needed for proper web formation.

Figure 11:
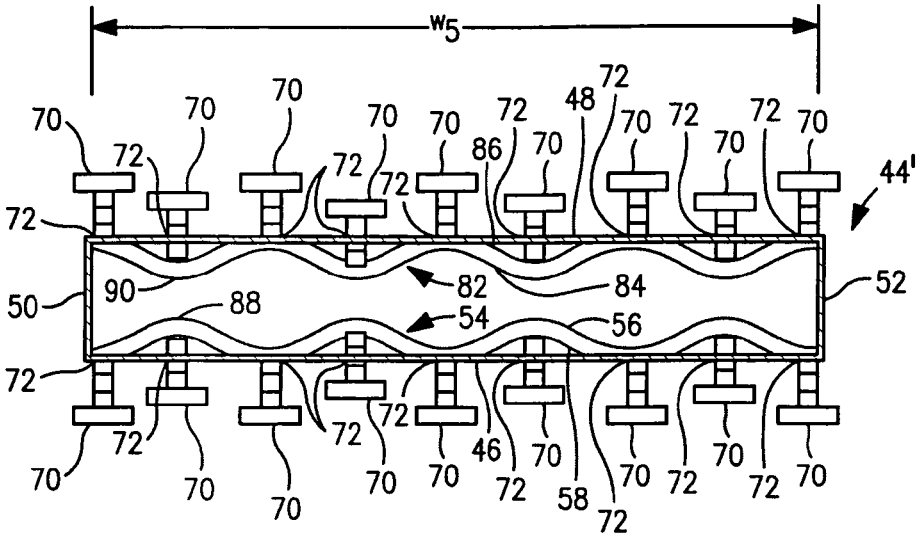
FIG. 11 is a cross-sectional view of an alternative embodiment of the outlet opening of the discharge member showing first and second flexible plates each being deflected by a plurality of screws arranged across the outlet opening such that both plates acquire an undulating contour to further control the basis weight of the to be formed uniform non-woven fibrous web.

Referring now to FIG. 11, an alternative embodiment is shown wherein a second flexible plate 82 is positioned within the discharge member 40 and aligned adjacent to the second major wall 48. The second flexible plate 82 can vary in size and configuration. Desirably, the second flexible plate 82 is identical in dimensions to the first flexible plate 54. The second flexible plate 82 can be constructed from the same material as the first flexible plate 54 or be constructed from a different material. The second flexible plate 82 also has a width $w_5$ which is equal to the width $w_4$ of the first flexible plate 54. The width $w_5$ of the second flexible plate 82 is aligned parallel to the width $w_3$ of the outlet opening 44'. The width $w_5$ is slightly less than the width $w_3$ of the discharge member 40. The second flexible plate 82 spans across the width of the outlet opening 44' and has an inner surface 84 and an outer surface 86. A plurality of screws 70, identical to the screws 70 discussed above, is positioned across said width $w_4$ of the discharge member 40 or across the width of the outlet opening 44'. Each of the screws 70 is capable of being adjusted so as to contact and possibly deflect or distort the outer surface 86 of the second flexible plate 82 and impart a corresponding contour to the inner surface 84 of the second flexible plate 82. Each of the screws 70 can be adjusted by a similar or by a different amount so that the inner surfaces 56 and 84 of the first and second flexible plates, 54 and 82 respectively, can be distorted as needed and the trajectory of the pressurized gaseous stream 24 containing the plurality of individual fibers 22 can be further controlled.

The plurality of screws 70 can be adjusted to cause a deflection of each of the first and second flexible plates, 54 and 82 respectively, up to about 1 inch or more from a flat profile and cause a change in surface contour which can result in a change of as much as ±5 grams per square meter along the width of the uniform non-woven fibrous web 12 formed on the apparatus 10.

Desirably, the second flexible plate 82 is identical in size and dimension to the first flexible plate 54. The second flexible plate 82 should have a length of at least about 2 inches, a width $w_5$ slightly less than the width $w_3$ of the discharge member 40, and a thickness of less than about 0.2 inches. The second flexible plate 82 also has a leading edge secure to the second major wall 48 and an unsecured edge located downstream of the secured edge. The second flexible plate 82 can be secured to the second major wall 48 in the same fashion as the first flexible plate 54 is secured to the first major wall 46.

Still referring to FIG. 11, one can see that the second flexible plate 82 can be deflected or distorted into an undulating pattern similar or identical to the undulating pattern imparted into the first flexible plate 54. As with the first flexible plate 54, the second flexible plate 82 can be deflected or distorted into almost any desired geometrical pattern. When the first and second flexible plates, 54 and 82 respectively, are utilized, the vertical opening of the outlet opening 44' is reduced. For example, in FIG. 11, at least one point on the second flexible plate 82 can be spaced less than 1.5 inches from a point on the first flexible plate 54. Desirably, at least one point on the second flexible plate 82 can be spaced less than 1 inch from a point on the first flexible plate 54. Furthermore, each of the first and second flexible plates, 54 and 82 respectively, can be deflected into an undulating contour by the plurality of screws 70 such that an apex 88 formed in the first flexible plate 54 is vertically aligned with an apex 90 formed in the second flexible plate 82. The distance between the two apexes can be less than about 1.5 inches, desirably, less than about 1 inch, and more desirably, less than about 0.75 inches.

By adjusting the size and shape of the outlet opening 44', one can control the velocity of the pressurized gaseous stream 24 and the individual fibers 22 contained therein. This fine tuning of the pressurized gaseous stream 24 can result in a ±5 grams per square meter adjustment in the cross direction of the finished non-woven fibrous web 12. By finely adjusting the size and shape of the outlet opening 44', one can dry form a uniform non-woven fibrous web having a basis weight of less than about 100 grams per square meter (gsm) at acceptable production line speeds. In fact, uniform non-woven fibrous webs 12 having a basis weight of about 75 grams per square meter (gsm), about 50 gsm, about 30 gsm, and even webs 12 having a basis weight of about 20 gsm can be produced. Up until now, it has been extremely difficult to dry form uniform non-woven webs of such low basis weights at acceptable production line speeds.

Figure 12:
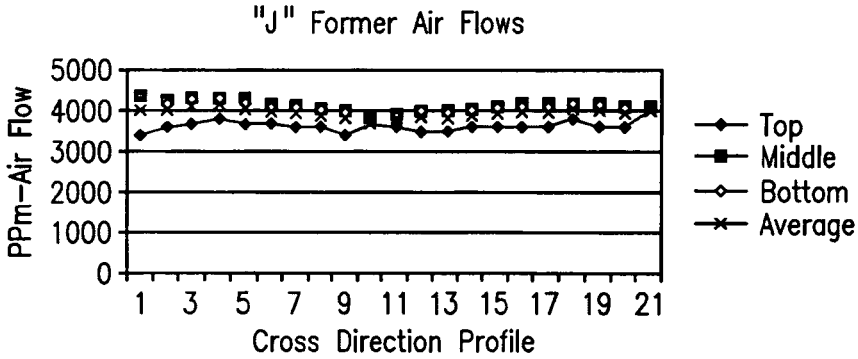
FIG. 12 is a chart showing the flow profiles of the discharged fibers exiting the outlet opening of the discharge member.

Referring now to FIG. 12, a chart is depicted that shows the gaseous (air) stream profiles that can be achieved by using the apparatus 10. This data was obtained without modifying the contour of the inner surface 56 of the first flexible plate 54 by tightening the screws 70. The second flexible plate 82 was not present in this trial. The gaseous (air) stream profile can be basically made totally flat when the first flexible plate 54, shown in FIG. 10, is implemented by making adjustments to the screws 70. The gaseous (air) stream profile can also be refined when both of the first and second flexible plates, 54 and 82 respectively, are utilized and each of the first and second flexible plates, 54 and 82 respectively, are deflected by tightening the screws 70.

Figure 13:
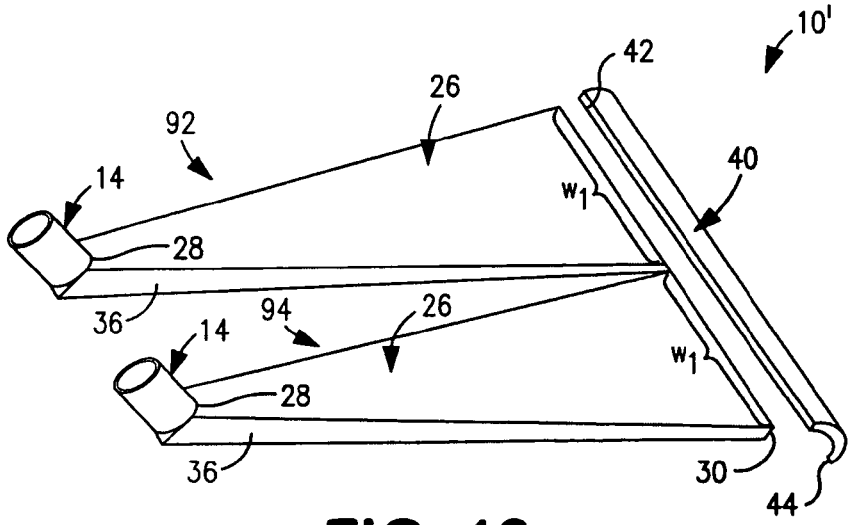
FIG. 13 is a perspective view of an apparatus having identical first and second modular units arranged side by side to form a continuous, monolithic web having double the width of a web produced from the first modular unit alone.

Referring now to FIG. 13, a unitary assembly 10' is shown which consist of two of the apparatuses 10 shown in FIG. 1. A first modular unit 92 having a spreading member 26 with an outlet width $w_1$ of from between about 1 to about 2 meters, and a second modular unit 94, having a spreading member 26 with an outlet width $w_1$ of similar or identical construction, is positioned transversely adjacent to the first modular unit 92 to form a unitary assembly 10'. The unitary assembly 10' is capable of producing a continuous, monolithic web having double the width of a web 12 produced from the first modular unit 92 alone. By monolithic it is meant constituting or acting as a single, often uniform whole.

In FIG. 13, the inlet opening 42 of the discharge member 40 is spaced away from the outlet 30 of the spreading member 26 simply for the purpose of representing the double width of the discharge member 40. In operation, the inlet opening 42 of the discharge member 40 is directly attached to the outlet 30 of the spreading members 26, 26 of the first and second modular units, 92 and 94 respectively.

It should be understood that any number of modular units, of similar or identical construction, can be positioned side by side to produce a uniform non-woven fibrous web of any desired width. There is no limitation on the number of modular units that can be so arranged. The ability to arrange a required number of modular units allows one to form uniform non-woven fibrous webs having a width of 5 meters or more. For practical purposes, an ideal width $w_3$ for the outlet opening 44 of an individual discharge member 40 is in the range of about 1 meter to about 1.5 meters. Three, four, five, six or more modular units can be employed in a side-by-side relationship, if needed.

In FIG. 13, even though the spreading members 26, 26, with their respective inlets 28, 28, are separate units, the discharge member 40 has a continuous, monolithic outlet opening 44. Because of this, the fibers 22 are gaseous (air) formed with a uniform cross direction when discharged onto the forming zone 74 without any separation as a result of combining the separate spreading members 26, 26 through the unitary discharge member 40.

Method

Referring now to the flow diagram shown in FIG. 14, a method of dry forming a uniform non-woven fibrous web will be described. The method includes the steps of forming a plurality of individual fibers 22 and routing the plurality of individual fibers 22 through a transport duct 14 using a pressurized gaseous (air) stream 24. The transport duct 14 has a predetermined cross-sectional area with a constant diameter d. The transport duct 14 has an entrance 16 and an exit 18. The pressurized gaseous stream 24 has a velocity of at least about 1,000 feet per minute. The velocity of the pressurized gaseous stream containing the plurality of fibers can be dissipated at the inlet into the spreading member 26 so that the iso-kinetic energy of the plurality of individual fibers 22 is reduced.

The method also includes directing the pressurized gaseous stream 24 containing the plurality of individual fibers 22 to a spreading member 26. The spreading member 26 has an inlet 28, an outlet 30 and a length $l_1$ therebetween. The length $l_1$ is at least 20 times the diameter d of the transport duct 14. The spreading member 26 is a hollow enclosure having first and second major walls, 32 and 34 respectively, connected together by a pair of side walls, 36 and 38 to form a rectangular cross-sectional configuration. The rectangular cross-sectional configuration has a width $w_1$ and a height $h_1$. The width $w_1$ constantly increases in dimension along the length $l_1$ from the inlet 28 to the outlet 30, and the height $h_1$ constantly decreases in dimension along the length $l_1$ from the inlet 28 to the outlet 30. The height $h_1$ is less than the width $w_1$ at the outlet 30. The inlet 28 of the spreading member 26 is connected to the exit 18 of the transport duct 14 and the exit 18 is aligned at an angle of at least about 15° to the second major wall 34. The pressurized gaseous stream 24 passing through the spreading member 26 is maintained at a constant or slightly accelerating velocity and with a minimum amount of turbulence.

The method further includes directing the pressurized gaseous stream 24 containing the plurality of individual fibers 22 to a discharge member 40 having an inlet opening 42, an outlet opening 44 and a length $l_2$ therebetween. The inlet opening 42 is connected to the outlet 30 of the spreading member 26 and has an identical size and cross-sectional configuration as the outlet 30. The discharge member 40 has first and second major walls, 46 and 48 respectively, connected together by a pair of side walls 50 and 52 to form a rectangular cross-sectional configuration having a width $w_3$ and a height $h_3$. The width $w_3$ is greater than the height $h_3$. The discharge member 40 has a first flexible plate 54 positioned therein which is aligned adjacent to the first major wall 46. The first flexible plate 54 spans across the width $w_3$ of the outlet opening 44 and has an inner surface 56 and an outer surface 58. A plurality of screws 70 is positioned across the width $w_3$ of the discharge member 40 or across the width of the outlet opening 44. Each of the screws 70 is capable of being adjusted so as to contact and deflect or distort the outer surface 58 of the first flexible plate 54 and impart a corresponding contour to the inner surface 56 of the first flexible plate 54.

The method further includes depositing the plurality of individual fibers 22 from the outlet opening 44 onto a forming zone 74 to form a uniform non-woven fibrous web 12. The forming zone can be a forming screen 74 or any other type of forming mechanism known to those skilled in the art.

In this method, it is advantageous to maintain the velocity of the plurality of individual fibers 22 within the pressurized gaseous stream 24 through the transport duct 14. It is also advantageous to dissipate the velocity of the pressurized gaseous stream 24 containing the plurality of fibers 22 upstream of the inlet 28 into the spreading member 26 so that the iso-kinetic energy of the plurality of individual fibers 22 is reduced.

The pressurized gaseous stream 24 containing the plurality of individual fibers 22, which exits the transport duct 14, will enter the inlet 28 of the spreading member 26 at an angle of from between about 15° to about 75°. This will cause the plurality of individual fibers 22 to strike an inner surface of the second major wall 34 of the spreading member 26. This action will allow the velocity and momentum of the plurality of individual fibers 22 to dissipate and the plurality of fibers 22 will be re-aligned with airflow profiles in the spreading member 26.

Alternatively, the method can be used with an apparatus 10 having a discharge member 40 with first and second flexible plates, 54 and 82 respectively. The second flexible plate 82 is positioned within the discharge member 40 and is aligned adjacent to the second major wall 48. The second flexible plate 82 has a width $w_5$ which spans across the width of the outlet opening 44' and has an inner surface 84 and an outer surface 86. A plurality of screws 70 is positioned across the width $w_3$ of the second major wall 48. Each of the screws 70 is capable of being adjusted so as to contact and deflect the outer surface 86 of the second flexible plate 82 and impart a corresponding contour to the inner surface 84 of the second flexible plate 82.

While the invention has been described in conjunction with several specific embodiments, it is to be understood that many alternatives, modifications and variations will be apparent to those skilled in the art in light of the foregoing description. Accordingly, this invention is intended to embrace all such alternatives, modifications and variations which fall within the spirit and scope of the appended claims.

I claim:

1. An apparatus for dry forming a uniform non-woven fibrous web, comprising:

a) a transport duct having a predetermined cross-sectional area, said transport duct having an entrance and an exit, said entrance being connected to a source of individual fibers and a pressurized gaseous stream, and said transport duct capable of routing a plurality of said individual fibers contained within said pressurized gaseous stream through to said exit;

b) a spreading member having an inlet, an outlet and having a length therebetween, said spreading member being a hollow enclosure having first and second major walls connected together by a pair of side walls to form a rectangular cross-sectional configuration having a width and a height, said width constantly increasing in dimension along said length from said inlet to said outlet and said height constantly decreasing in dimension along said length from said inlet to said outlet, said height being less than said width at said outlet, said inlet of said spreading member being connected to said exit of said transport duct and said exit being aligned at an angle of at least about 15° to said second major wall, and said pressurized gaseous stream passing through said spreading member being maintained at a constant or slightly accelerating velocity and with a minimum amount of turbulence;

c) a discharge member having an inlet opening, an outlet opening and a length therebetween, said inlet opening being connected to said outlet of said spreading member and having an identical size and cross-sectional configuration as said outlet, said discharge member having first and second major walls connected together by a pair of side walls to form a rectangular cross-sectional configuration having a width and a height, said width being greater than said height;

d) a first flexible plate positioned within said discharge member and aligned adjacent to said first major wall, said first flexible plate spanning across said outlet opening and having an inner surface and an outer surface;

e) a plurality of screws positioned across said outlet opening, each of said screws capable of being adjusted so as to contact and deflect said outer surface of said first flexible plate and impart a corresponding contour to said inner surface of said first flexible plate; and f) a forming zone located below said outlet opening of said discharge member onto which said plurality of individual fibers can be deposited to form a uniform non-woven fibrous web.

2. The apparatus of claim 1 wherein said transport duct has a constant diameter and said pressurized gaseous stream is a pressurized air stream which is routed through said transport duct at a concentration of at least about 350 cubic feet of air per pound of fibers, and said formed uniform non-woven fibrous web has a basis weight of less than about 100 grams per square meter.

3. The apparatus of claim 2 wherein said first flexible plate has a length of at least about 2 inches, a width corresponding to said outlet opening and a thickness of less than about 0.2 inches, said first flexible plate having a leading edge secured to said first major wall and an unsecured edge located downstream from said leading edge.

4. The apparatus of claim 1 wherein each of said first and second major walls of said spreading member has a trapezoidal configuration which increases in width from said inlet to said outlet, and said first major wall angles downward from said inlet to said outlet while said second major wall is horizontally aligned from said inlet to said outlet.

5. The apparatus of claim 1 wherein said first flexible plate has a length of less than about 6 inches and there are at least 3 screws per foot spaced across said width of said discharge member.

6. The apparatus of claim 5 wherein there are at least 9 screws evenly spaced across said width of said discharge member and each of said screws has a distance of travel which ranges from between 0.1 inches to about 3 inches.

7. The apparatus of claim 1 further comprising a second flexible plate positioned within said discharge member and aligned adjacent to said second major member, said second flexible plate spanning across said outlet opening and having an inner surface and an outer surface, and a plurality of screws positioned across said outlet opening, each of said screws capable of being adjusted so as to contact and deflect said outer surface of said second flexible plate and impart a corresponding contour to said inner surface of said second flexible plate.

8. The apparatus of claim 7 wherein said second flexible plate has a length of at least about 2 inches, a width corresponding to said width of said outlet opening and a thickness of less than about 0.2 inches, said second flexible plate having a leading edge secured to said second major member and an unsecured edge located downstream of said leading edge, and at least one point on said second flexible plate is spaced less than 2 inches from a point on said first flexible plate.

9. The apparatus of claim 8 wherein each of said first and second flexible plates is deflected into an undulating contour by said plurality of screws and an apex formed in said first flexible plate is vertically aligned with an apex formed in said second flexible plate.

10. An apparatus for dry forming a uniform non-woven fibrous web, comprising:

a) a transport duct having a predetermined cross-sectional area, said transport duct having an entrance and an exit, said entrance being connected to a source of individual fibers and a pressurized gaseous stream, and said transport duct capable of routing a plurality of said individual fibers contained within said pressurized gaseous stream through to said exit;

b) a spreading member having an inlet, an outlet and having a length therebetween which is at least 20 times said diameter of said transport duct, said spreading member being a hollow enclosure having first and second major walls connected together by a pair of side walls to form a rectangular cross-sectional configuration having a width and a height, said width constantly increasing in dimension along said length from said inlet to said outlet and said height constantly decreasing in dimension along said length from said inlet to said outlet, said height being less than said width at said outlet, said inlet of said spreading member being connected to said exit of said transport duct and said exit being aligned at an angle of from between about 15° to about 75° to said second major wall, and said pressurized gaseous stream passing through said spreading member being maintained at a constant or slightly accelerating velocity and with a minimum amount of turbulence;

c) a discharge member having an inlet opening, an outlet opening and an arcuate configuration therebetween spanning an arc of from between about 1° to about 90°, said inlet opening being connected to said outlet of said spreading member and having an identical size and cross-sectional configuration as said outlet, said discharge member having first and second major walls connected together by a pair of side walls to form a rectangular cross-sectional configuration having a width and a height, said width being greater than said height, said discharge member having a constant cross-section between said inlet opening and said outlet opening;

d) a first flexible plate positioned within said discharge member and aligned adjacent to said first major wall, said first flexible plate spanning across said outlet opening and having an inner surface and an outer surface;

e) a second flexible plate positioned within said discharge member and aligned adjacent to said second major wall, said second flexible plate spanning across said outlet opening and having an inner surface and an outer surface;

f) a plurality of screws positioned across said outlet opening, each of said screws capable of being adjusted so as to contact and possibly deflect said outer surface of said first and second flexible plates and impart a corresponding contour to said inner surface of said corresponding first and second flexible plates; and g) a forming zone located below said outlet opening of said discharge member onto which said plurality of individual fibers can be deposited to form a uniform non-woven fibrous web.

11. The apparatus of claim 10 wherein each of said first and second flexible plates has a length of at least about 2 inches, a width corresponding to said outlet opening and a thickness of less than about 0.2 inches, said first flexible plate having a leading edge secure to said first major member and an unsecured edge located downstream of said leading edge, said second flexible plate having a leading edge secure to said second major member and an unsecured edge located downstream of said leading edge.

12. The apparatus of claim 10 wherein said apparatus is a first modular unit having a width of from between about 1 to about 2 meters and a second modular unit of identical construction is positioned transversely adjacent to said first modular unit to form a unitary assembly, said unitary assembly is capable of producing a continuous, monolithic web having double the width of a web produced from said first modular unit alone.

13. The apparatus of claim 10 wherein as each of said plurality of screws is adjusted by a different amount, said inner surfaces of each of said first and second flexible plates become distorted and the trajectory of said pressurized gaseous stream containing said plurality of fibers can be further controlled.

14. The apparatus of claim 13 wherein said plurality of screws can be adjusted to cause a deflection of each of said first and second flexible plates up to about 1 inch from a flat profile and cause a change in surface contour which can result in a change of as much as ±5 grams per square meter along said width of said uniform non-woven fibrous web which is being formed on said apparatus.

15. A method of dry forming a uniform non-woven fibrous web comprising the steps of:

a) forming a plurality of individual fibers;

b) routing said plurality of individual fibers through a transport duct by a pressurized gaseous stream, said transport duct having a predetermined cross-sectional area, said transport duct having an entrance and an exit, and said pressurized gaseous stream having a velocity of at least about 1,000 feet per minute;

c) directing said pressurized gaseous stream containing said plurality of individual fibers to a spreading member, said spreading member having an inlet, an outlet and having a length therebetween which is at least 20 times said diameter of said transport duct, said spreading member being a hollow enclosure having first and second major walls connected together by a pair of side walls to form a rectangular cross-sectional configuration having a width and a height, said width constantly increasing in dimension along said length from said inlet to said outlet and said height constantly decreasing in dimension along said length from said inlet to said outlet, said height being less than said width at said outlet, said inlet of said spreading member being connected to said exit of said transport duct and said exit being aligned at an angle of at least about 15° to said second major wall, and said pressurized gaseous stream passing through said spreading member being maintained at a constant or slightly accelerating velocity and with a minimum amount of turbulence;

d) directing said pressurized gaseous stream containing said plurality of individual fibers to a discharge member having an inlet opening, an outlet opening and a length therebetween, said inlet opening being connected to said outlet of said spreading member and having an identical size and cross-sectional configuration as said outlet, said discharge member having first and second major walls connected together by a pair of side walls to form a rectangular cross-sectional configuration having a width and a height, said width being greater than said height, said discharge member having a first flexible plate positioned therein and aligned adjacent to said first major wall, said first flexible plate spanning across said outlet opening and having an inner surface and an outer surface, and a plurality of screws positioned across said outlet opening, each of said screws capable of being adjusted so as to contact and deflect said outer surface of said first flexible plate and impart a corresponding contour to said inner surface of said first flexible plate; and e) depositing said plurality of individual fibers from said outlet opening onto a forming zone to form a uniform non-woven fibrous web.

16. The method of claim 15 further comprising maintaining the velocity of said plurality of individual fibers within said pressurized gaseous stream through said transport duct.

17. The method of claim 15 further comprising dissipating the velocity of said pressurized gaseous stream containing said plurality of fibers at said inlet into said spreading member so that the iso-kinetic energy of said plurality of individual fibers is reduced.

18. The method of claim 15 wherein said pressurized gaseous stream containing said plurality of fibers which exits said transport duct will enter said inlet of said spreading member at an angle of from between about 15° to about 75° and strike an inner surface of said second major wall of said spreading member so that the velocity and momentum of said plurality of fibers will dissipate and said plurality of fibers will be re-aligned with airflow profiles in said spreading member.

19. The method of claim 15 further comprising using a discharge member having a second flexible plate positioned therein which is aligned adjacent to said second major wall, said second flexible plate spanning across said outlet opening and having an inner surface and an outer surface, and a plurality of screws positioned across said outlet opening, each of said screws capable of being adjusted so as to contact and deflect said outer surface of said second flexible plate and impart a corresponding contour to said inner surface of said second flexible plate.

20. The method of claim 15 further comprising depositing said plurality of individual fibers from said outlet opening onto a forming screen.

* * * * *